United States Patent [19]

Mayer

[11] 4,103,782

[45] Aug. 1, 1978

[54] DISPLAY UNITS

[76] Inventor: Raymond E. Mayer, 88 Salem Rd., Schwenksville, Pa. 19473

[21] Appl. No.: 693,309

[22] Filed: Jun. 7, 1976

[51] Int. Cl.[2] ..... A47F 3/14

[52] U.S. Cl. ..... 211/126; 211/186; 312/107

[58] Field of Search ..... 211/13, 88, 90, 126, 211/128, 186, 189, 188, 194, 190; 312/107, 108, 111, 114, 116–119, 122, 126, 128, 214, 138 A, 257 R, 257 A, 257 SK, 261; 108/111

[56] References Cited

U.S. PATENT DOCUMENTS

| | | | |
|---|---|---|---|
| 2,746,828 | 5/1956 | Amore | 312/214 |
| 2,811,404 | 10/1957 | Brooks et al. | 312/122 |
| 3,581,906 | 6/1971 | Joyce | 211/126 |
| 3,684,103 | 8/1972 | Belluder | 312/257 R X |
| 3,695,455 | 10/1972 | Larson | 211/78 |
| 3,848,942 | 11/1974 | Fanini | 312/214 X |

FOREIGN PATENT DOCUMENTS

| | | | |
|---|---|---|---|
| 99,339 | 7/1964 | Denmark | 211/190 |
| 975,189 | 10/1950 | France | 312/114 |
| 2,242,002 | 3/1975 | France | 312/107 |
| 926,448 | 4/1955 | Fed. Rep. of Germany | 211/194 |

*Primary Examiner*—Roy D. Frazier
*Assistant Examiner*—Terrell P. Lewis
*Attorney, Agent, or Firm*—Frederick J. Olsson

[57] ABSTRACT

2 inch × 8 inch flake boards form side panels which stand upright on the floor. A plurality of display trays are stacked one upon the other between the panels. The panels have retaining grooves on facing surfaces. The trays have retaining tongues fitting into the retaining grooves on the panels. The panels and trays are held together as a complete unit. In the preferred form, the trays are assembled to the panels by sliding the trays axially along the grooves and disassembled by sliding axially out of the grooves and the tongues and grooves are angled to perform the holding function.

5 Claims, 8 Drawing Figures

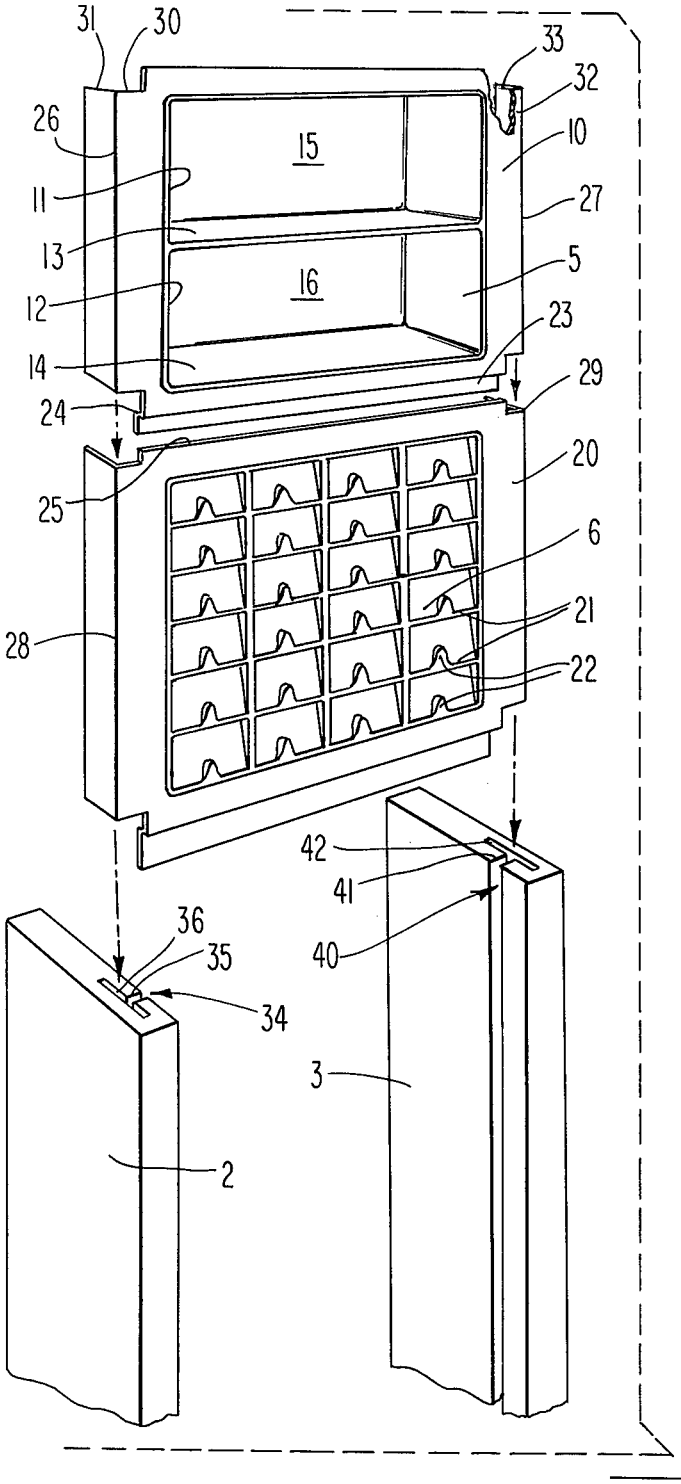
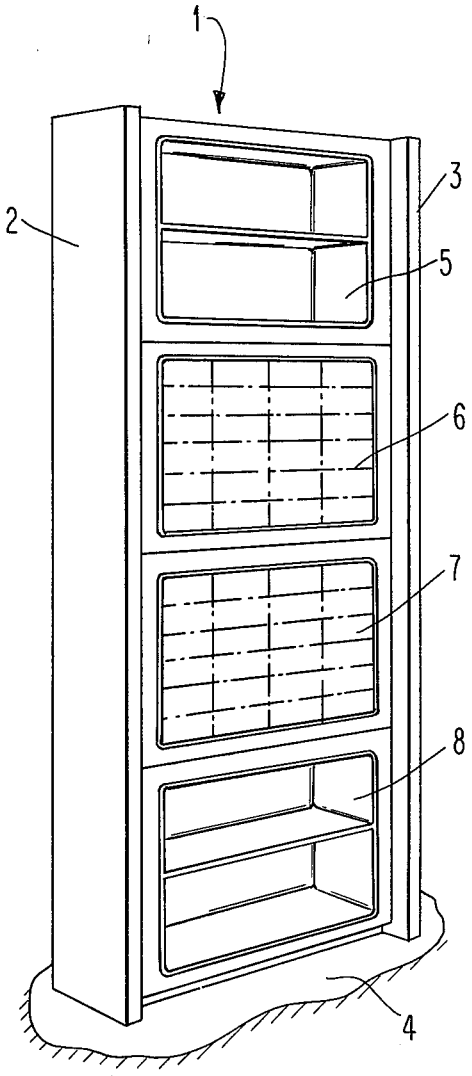
Fig. 1
Fig. 2

DISPLAY UNITS

The invention relates in general to display and store fixtures and more specifically to composite wall simulating and article display/storage units.

The invention finds particular utility for newly constructed and/or renovated stores especially where visable merchandise.

The invention contemplates a pair of 2 feet × 8 feet flake or particle boards set-up on a floor in spaced-parallel relationship and forming side supports with a plurality of trays stacked one upon the other and extending between the panels. Slide inslide out type fastening hold the panels and trays together as a unit. The units are quickly assembled and disassembled without the use of tools.

One advantage of the invention is that it is highly versatile. The units are adaptable for most all conventional display applications and the ability of the designers to develop inovative displays is measurably inhanced.

Another advantage of the invention is that it is especially suitable for use in service establishments such as accessory and optical departments which need singular units for holding merchandise and which can readily be assembled and disassembled without tools so as to change the display and/or to move the unit to a different location.

Another advantage of the invention is that it permits cost reduction for new and renovated situations. The units extend approximately 8 feet high and when placed against the wall are the center of attention and therefore allow the area above the walls to be inexpensively finished. Moreover, the units can replace and supplant expensive conventional cabinets and fixtures.

The invention will be described below in connection with the following drawings wherein:

FIG. 1 is a perspective view of a vertical display unit constructed in accordance with the invention;

FIG. 2 is an exploded perspective view of the top portion of the components of FIG. 1.

Figure 3:
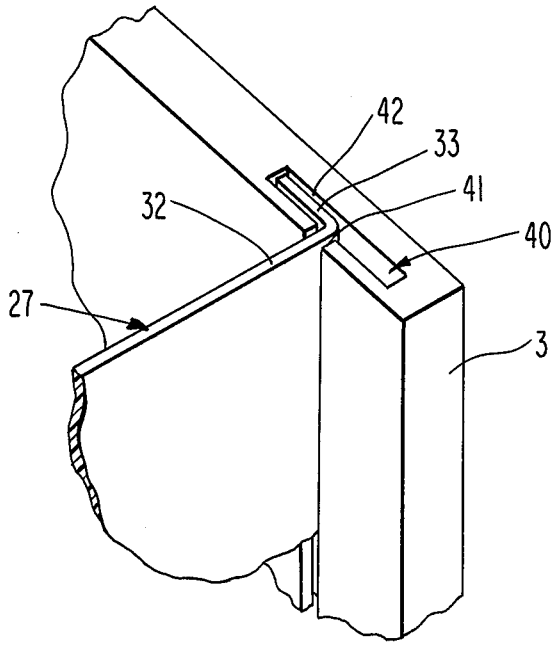
FIG. 3 is a fragmentary perspective view showing the retaining tongue and retaining groove arrangement of FIG. 1.

The invention will be described primarily in terms of display units for stores and similar outlets, however, it will be understood that the invention has wide uses in a variety of areas. For example, in the home for bookshelves, knick-naks, spice compartments, grocery shelves, junk shelves, and other like storage areas. In offices, the invention can be adapted for bookshelves, and is a quick access storage area for various types of small office equipment. In commercial establishments and industrial plants, for example, in lobbys or waiting rooms, the units can be adapted to hold various items which are manufactured or sold by the particular organization and/or hold trade publications and the like. Since the units of the invention are readily disassembled and washable the same can be adapted for use in clinics and hospitals for storage and/or displaying a wide variety of items.

In FIG. 1 the display unit 1 has a pair of side supports or panels 2 and 3 which stand upright on floor 4. Between the panels are a plurality of trays 5, 6, 7 and 8 which are stacked one on top of the other with the bottom tray 8 resting on the floor 4. The trays are positively engaged with the panels by retaining tongues fitting into retaining grooves.

The supports 2 and 3 are preferably made from 4 feet × 8 feet particle or flake board (cut in half) and having a melamine, vinyl or polyester finish on both faces. The visable edges are striped with a compatible tape, wooden, metal or plastic lamimate facing material.

Except for the display/storage means for supporting the articles or merchandise the trays are identical in construction. The trays are formed using conventional vacuum or molding techniques and use the conventional high-strength plastics.

The tray 5 has flat, front wall 10 and the display/storage means comprises the openings 11 and 21 and shelves 13 and 14 connected to and extending rearwardly of wall 10. The shelves are preferable enclosed by the enclosures 15 and 16. In the embodiment shown, the tray 8 is identical to the tray 5.

The tray 6 has a flat, front wall 20 and the storage/-display means comprises the opening 21 and frame support means 22 for carrying eye-glass frames not shown. The tray 7 is identical to tray 6.

On tray 5 there is skirt 23 which extends downwardly and is offset to the rear. The amount of offset is just sufficient so that when the tray 5 is down on the tray 6 (as in FIG. 1) the skirt engages the rear surface of the wall 20. This engagement functions to lock the panels together in a direction normal to the walls 10 and 20. Also the offset form horizontal shoulder 24 which rests on the top 25 of the wall 20.

The retaining tongues and retaining grooves will next be described especially in connection with FIGS. 2 and 3.

The tray 5 has a tongue 26 along one edge and an identical tongue 27 along the opposite edge. The tray 6 has tongues 28 and 29.

The tongues 26 and 27 has leg section 30 and foot section 31 and the tongue 27 has leg section 32 and foot section 33. In the embodiment shown, foot section is co-planar with the wall 10 and each tongue is oriented at a right angle to its leg section. The tongues 28 and 29 on the tray 6 are similarly constructed.

On the inside surface of the panel 2 is a retaining groove 34 has a leg section 35 and a foot section 36. The leg section 35 is open to and generally normal to the inside surface of the panel. The foot section 36 is open and generally normal to the leg section 35.

On the inside surface of panel 3 is a retaining groove 40 having leg section 41 and foot section 42. The groove 40 extends along the full length of the panel. The leg section 40 is open and normal to the inside surface. The foot section 42 is open and normal to the leg section 41. The panels 2 and 3 are set up on the floor so that the leg sections 35 and 41 are aligned.

As will be noted with reference to FIG. 3, the leg sections and the retaining grooves are adapted to accept the leg sections of the tongues and the foot section of the grooves are adapted to accept the foot sections of the tongues. The tongues and grooves are dimensioned so that the tongues make a sliding but snug fit with the grooves.

For assembly purposes, the panels 1 and 2 are held vertically in the position shown in FIG. 2, or the panels can be set out horizontally with the rear edge resting on the floor and with the grooves 34 and 40 aligned. Then a tray is positioned with its tongues co-axial with the grooves and the tray pushed axially so that the tongue slide along the grooves. The other trays are similarly put into the assembly. To disassemble the trays are simply pulled or pushed axially out of the grooves.

When the trays are in place as shown in FIG. 1, the tongues and grooves firmly hold the assembly together. The angled configuration provides that a retaining groove retain its tongue against motion transverse the axis of the groove so that the supports do not pull away from the trays and remain parallel. The snug, sliding fit provides for side to side stability.

Figure 4:
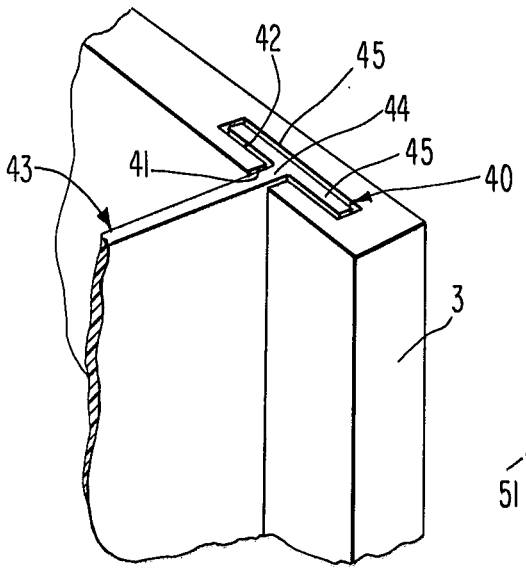
FIG. 4 is an alternative form of retaining tongue and groove arrangement.

In the embodiment described above the retaining tongues are generally L-shaped. However, the invention contemplates that the tongue may assume a different shape, for example, in the form of a T as indicated in FIG. 4 wherein the retaining tongue 43 has leg section 44 and foot sections 45 which respectively fit into the leg section 41 and foot section 42 of groove 40.

Also, while I have shown the angle configuration of the tongues and grooves of FIG. 2 to be a 90°, it will be understood that the invention contemplates other angles such as 45°.

The retaining grooves in the above described embodiments are formed by conventional milling techniques. For example, a groove is milled along the axis of the panel to form the leg section and subsequently a slot is milled to form the foot section. In the second operation, the leg slot accommodates the shaft mounting the cutter forming the foot section.

Figure 5:
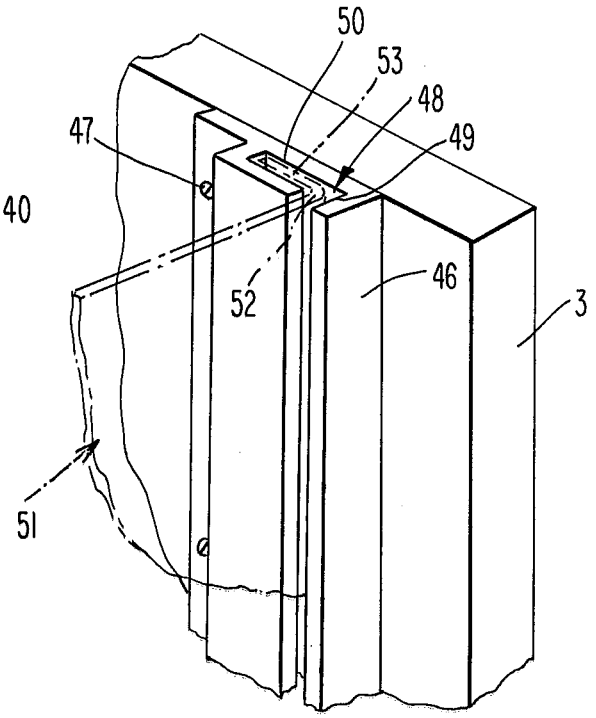
FIG. 5 is an alternative form of the tongue and groove arrangement.

In lieu of forming the retaining grooves internally the invention contemplates an alternative arrangement such as in FIG. 5.

An extrusion 46 is mounted on the inside surface of a panel such as panel 3 and is co-extensive therewith. The extrusion is held in place by the screws 47. Extrusion includes the retaining groove 48 having leg section 49 and foot section 50. The retaining tongue 51 of a tray has leg section 52 and foot section 53 fitting into the leg and foot sections of retaining groove 48.

Figures 6, 7, 8:
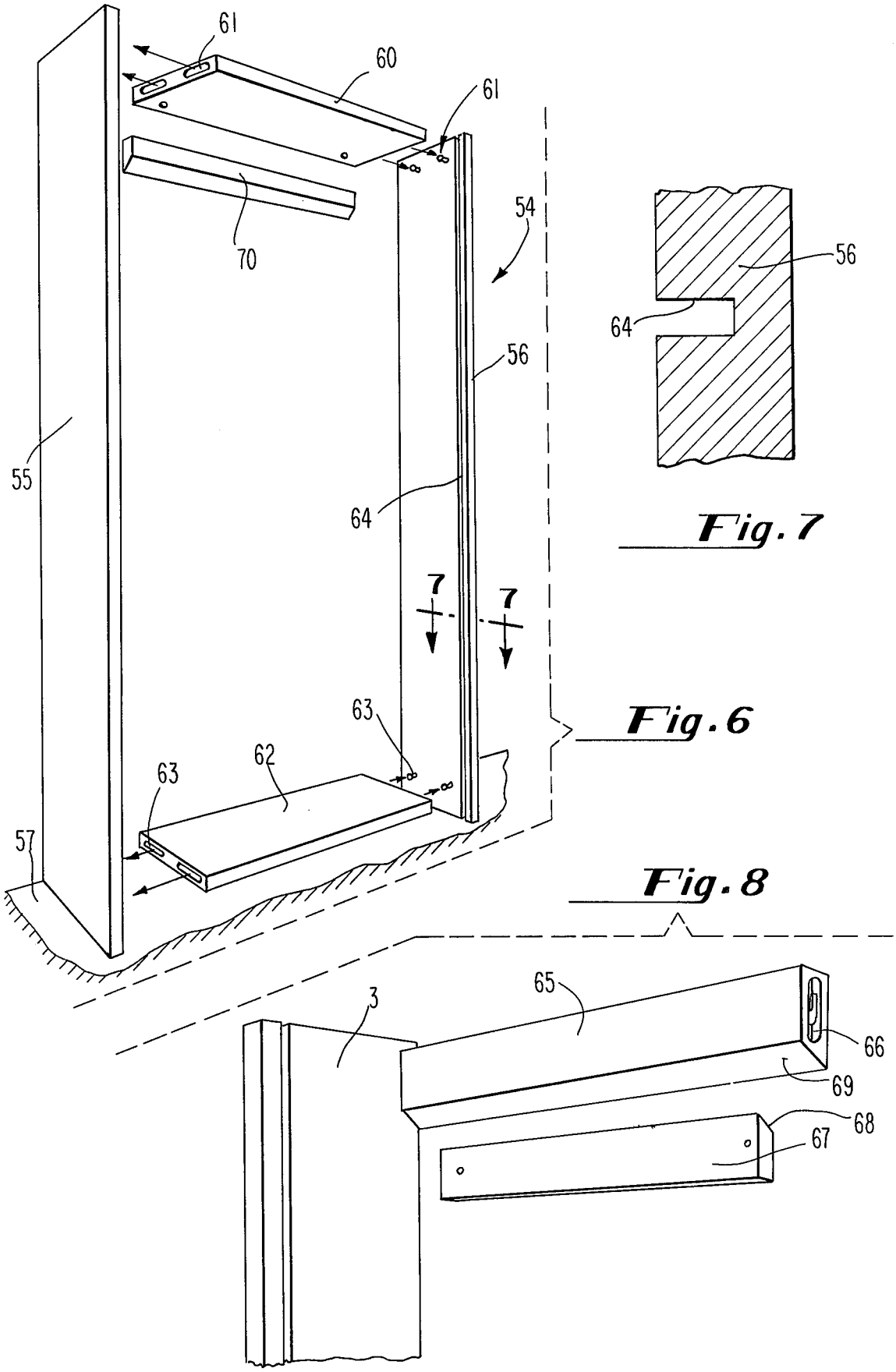
FIG. 6 is an exploded view of an alternative structure for a unit of the invention.
FIG. 7 is a sectional view taken along the lines 7—7 in FIG. 6.
FIG. 8 is a perspective view of a typical cleat arrangement for securing units to a building wall.

In the above embodiments of the invention; the means holding the panels and trays together as a unit comprise the tongues and grooves alone. The tongue and groove fastening means are not only functionally positive but also due to the sliding action provide for quick assembly and disassembly. An alternative arrangement which employs tongues and grooves together with additional quick acting (sliding) fasteneing means to hold the panels and trays together as a unit is shown in FIG. 6.

The unit 54 has a pair of side supports or panels 55 and 56 which stand upright on the floor 57. At the top of the unit is a top bridge 60 which extends between the panels and is connected thereto by the slide type fasteners 61. These are the same as the quick connent/disconnect fasteners shown in my co-pending application Ser. No. 589,621 filed June 23, 1975. The bridge is connected to the side panels simply by sliding the fastener parts together.

At the bottom of the unit is a bottom bridge 62 which extends between the panels and is connected by the fasteners 63 which are the same as the fasteners 61.

The facing surfaces of the panels 55, 56 have retaining grooves. The groove on panel 56 being indicated at 64. In contrast to the angled retaining grooves of the unit of FIG. 1, the groove 61 is linear as noted in FIG. 7. The retaining tongues on the trays (not shown) are also linear to fit into the grooves.

The trays used with the embodiment with FIG. 6 are the same as those trays previously described except for the shape of the retaining tongues.

To assemble the units of 56 the panels 55 and 56 are positioned as shown (or set edgewise on the floor) and the bottom bridge 62 put in place. The trays are then placed in position with the tongues in the grooves. After the topmost tray is positioned the top bridge 60 is connected into the assembly. The trays extend between the bridges.

It will be evident that top and bottom bridges together with the tongues of the trays being confined in the retaining grooves give overall side-to-side stability to the units. The bridges retain the panels so that the same can not be pulled away. The tongues and grooves maintain the trays so that they can not be pushed in or pulled out.

In the event that the units of FIG. 1 and FIG. 6 are to be secured to a wall a cleat arrangement is employed. A typical cleat arrangement for the units of FIG. 1 is shown in FIG. 8.

A cleat 65 extends between the panels 2 and 3 and is held in position on the panels by fasteners which are the same as the fasteners 61 and 63. One part of the fastener between the cleat 65 and the panel 3 is indicated at 66. A cleat retainer 67 is adapted to be fastened to the wall by any conventonal means. The retainer 67 and the cleat 66 have matching surfaces 68 and 69 which are angled to the horizontal. When the surfaces 68 and 69 are engaged, the cleat is retained on the wall and this in turn holds the unit against the wall.

The usual way of holding the unit against the wall is to first assemble the unit and then raise the assembly off the floor and put up against the wall with the cleat over the retainer and lower the unit until the surfaces 68 and 69 engage.

The units of FIG. 6 are arranged to be locked against the wall by a cleat 70 which is secured to the underside of the top bridge 60 and adapted to engage a cleat retainer. The unit of FIG. 6 is set up against the cleat and locked to the wall in the same manner as the unit of FIG. 1.

I claim:

1. A composite merchandise display and simulated building unit comprising:

a pair of side supports comprising elongated panels standing upright on a floor and the panels extending generally parallel one another;

on each panel, a retaining groove co-extensive with the panel and the grooves being formed on the sides of the panels which face one another;

a plurality of display trays extending between said panels, the trays being stacked one on top of the other;

means on each tray for supporting an article to be displayed and/or stored;

in each tray, a pair of tongues respectively formed on opposite sides of the tray and being respectively disposed in said retaining grooves;

said tongues and grooves being configured and dimensioned whereby each groove permits its tongue to slide axially along the groove and retains its tongue against motion transverse the axis of the groove whereby to hold the panels and trays together as a unit;

for each tray, a skirt means on the bottom of the tray below the front wall, the skirt means extending downwardly from the front wall and being offset to the rear;

for each tray, means on the top of the tray for use in being engaged by the skirt on the adjacent upper tray; and as between adjacent trays, the skirt on the upper tray engaging said means on the lower tray, said means providing vertical support for the upper tray.

2. The unit of claim 1 wherein said retaining grooves are formed by internal slots in the panel body.

3. The unit of claim 1 further including a pair of extrusions respectively fastened to the facing surfaces of said panels and the retaining grooves being formed in said extrusions.

4. The tray of claim 1 wherein the tongues are formed respectively on opposite edges of the front wall, each being an extension of the wall.

5. A composite merchandise display and simulated building unit comprising:

a pair of side supports comprising elongated panels standing upright on a floor and the panels extending generally parallel one another;

on each panel, a retaining groove co-extensive with the panel, the grooves being formed on the sides of the panels which face one another and each groove including a leg section and a foot section extending transverse the leg section whereby the groove is angled in cross section;

a plurality of display trays extending between said panels, the trays being stacked one on top of the other and each tray having a front wall;

an opening in said front wall;

means connected with the front wall and adjacent said opening for supporting an article to be displayed and/or stored;

on each tray, a pair of tongues respectively formed on opposite sides of said front wall and being respectively disposed in said retaining grooves, each tongue including a leg section and a foot section extending transverse the leg section whereby the tongue, in cross section, is angled the same as its groove and being dimensioned to make a snug, sliding fit with the leg and foot sections of its groove, the dimensions and angled configuration of the tongues and grooves providing that each groove permits its tongue to slide axially along the groove and retain its tongue against motion transverse the axis of the groove whereby said tongues and grooves hold the panels and trays together as a unit; and for each tray, skirt means on the bottom of the tray below the front wall, the skirt means extending downwardly from the front wall and being offset to the rear;

for each tray, means on the top of the tray for use in being engaged by the skirt on the adjacent upper tray; and as between adjacent trays, the skirt on the upper tray engaging said means on the lower tray, said means providing vertical support for the upper tray.

* * * * *